US007069836B1

(12) United States Patent
Palicka et al.

(10) Patent No.: US 7,069,836 B1
(45) Date of Patent: Jul. 4, 2006

(54) CERAMIC ARMOR AND METHOD OF MAKING BY ENCAPSULATION INCLUDING USE OF A STIFFENING PLATE

(75) Inventors: Richard Palicka, San Clemente, CA (US); Daniel Ashkin, San Marcos, CA (US)

(73) Assignee: Cercom, Inc., CA (US)

( * ) Notice: Subject to any disclaimer, the term of this patent is extended or adjusted under 35 U.S.C. 154(b) by 0 days.

(21) Appl. No.: 10/769,788

(22) Filed: Feb. 3, 2004

(51) Int. Cl.
*F41H 5/02* (2006.01)

(52) U.S. Cl. ..... 89/36.02; 89/36.04; 89/36.08; 109/49.5; 428/551

(58) Field of Classification Search ..... 89/36.02, 89/36.04, 36.05, 36.07, 36.08; 109/49.5; 428/221, 212, 75, 551
See application file for complete search history.

(56) References Cited

U.S. PATENT DOCUMENTS 3,616,115 A * 10/1971 Klimmek ..... 109/84
5,361,678 A * 11/1994 Roopchand et al. ..... 89/36.02
5,443,917 A * 8/1995 Tarry ..... 428/545
5,455,079 A * 10/1995 Oden et al. ..... 427/450
6,635,357 B1 * 10/2003 Moxson et al. ..... 428/548
2004/0020353 A1 * 2/2004 Ravid et al. ..... 89/36.02

* cited by examiner

*Primary Examiner*—J. Woodrow Eldred
(74) *Attorney, Agent, or Firm*—H. Jay Spiegel

(57) ABSTRACT

A ceramic armor is disclosed in several embodiments. In a first embodiment, a metal base plate has a metal frame assembled on it having a central opening into which the ceramic material and stiffening plate are placed. A cover plate is placed over the frame to enclose the ceramic material on all sides. In a second embodiment, the frame has an open central area that has two crossing walls that define four sub-chambers. Four sets of ceramic material and stiffening plate are placed in the respective sub-chambers and a covering plate is placed over them. In a further embodiment, the frame has a plurality of cavities mechanically formed in it. A stiffening plate and a ceramic tile or plate are placed in each cavity and a cover plate is placed over the frame. The metal used to encapsulate the ceramic material may, if desired, comprise a Titanium alloy such as Ti-6Al-4V, and the ceramic material may comprise Silicon Carbide, Boron Carbide, Tungsten Carbide, Titanium Diboride, Aluminum Oxide or Aluminum Nitride. The stiffening plate is preferably made of a Ti—TiB cermet composite but may also be comprised of an armor ceramic such as WC, $TiB_2$, $Al_2O_3$ or $B_4C$. A hot pressing procedure is carried out on the armor to cause the metal to plastically deform about the encapsulated ceramic material.

14 Claims, 7 Drawing Sheets

CERAMIC ARMOR AND METHOD OF MAKING BY ENCAPSULATION INCLUDING USE OF A STIFFENING PLATE

BACKGROUND OF THE INVENTION

The present invention relates to ceramic armor and the method of making it by encapsulation including use of a stiffening plate adjacent to the metal backing plate. Ceramic containing armor has been shown to be an effective means to protect against a wide variety of ballistic threats because of its combination of high hardness, strength and stiffness along with low bulk density and favorable pulverization characteristics upon impact.

However, ceramic material alone has been found to be ineffective against heavy ballistic threats such as Tungsten Carbide projectiles, and long rod heavy metal penetrators. Long rod projectiles can have a significant ratio of length to diameter, up to 40, and can travel at velocities up to or exceeding 1 mile per second. For the ceramic to effectively stop such threats, the ceramic material must be supported or encapsulated with another material such as metal or another composite capable of absorbing energy and providing stiffness support for the ceramic. Applicants have found that the use of a stiffening plate can also be advantageous.

However, merely mechanically assembling an armor consisting of ceramic material encapsulated by metal, and using a stiffening plate, without further processing, fails to optimize the ballistic performance of armor. As such, a need has developed for an encapsulated ceramic armor material that optimizes ballistic performance and may be manufactured in a repeatable, predictable way. It is with this thought in mind that the present invention was developed.

SUMMARY OF THE INVENTION

The present invention relates to a ceramic armor and the method of making it by encapsulation including use of a stiffening plate. The present invention includes the following interrelated objects, aspects and features:

(1) The inventive armor is disclosed in several structural embodiments which are considered to be exemplary of the teachings of the present invention. In a first such embodiment, a metal backing plate has a metal frame placed thereon having a central opening into which a stiffening plate is placed followed by a ceramic tile. A cover plate is placed over the frame to enclose the ceramic tile and stiffening plate on all sides.

(2) In a second embodiment of the present invention, a metal backing plate is covered by a frame having an open central area that has two crossing walls therein to define four sub-chambers. Four stiffening plates are placed in the respective sub-chambers followed by four respective ceramic pieces or tiles, and a covering plate is placed thereover.

(3) In a further embodiment, a flat backing plate is covered by a second plate in which a plurality of cavities have been mechanically formed. A stiffening plate is placed in each cavity, followed by a ceramic tile, and a cover plate is placed thereover.

(4) Concerning each of the embodiments described above, the metal used to encapsulate the ceramic material may, if desired, comprise a Titanium alloy such as Ti-6Al-4V. This material is particularly effective as a ballistic material because it has a relatively low density (4.5 g/cc), relatively high strength (900 MPa) and good ductility (yield strength of 830 MPa at 0.2% yield). Thermal expansion of Ti-6Al-4V is approximately $10.5\times10^{-6}$ in/in ° C. and deform about the ceramic, from 0–600° C. This coefficient of thermal expansion is considerably higher than that of dense SiC which is a common ceramic employed for armor applications. The thermal expansion of SiC is $4.1\times10^{-6}$ in/in ° C. from 0–600° C. The SiC material described may comprise, for example, PAD SiC-N ceramics.

(5) Concerning each of the embodiments described above, the stiffening plate is preferably made of a Ti—TiB cermet composite having an elastic modulus that is greater than the metal backing plate and a coefficient of thermal expansion close to that of the metal backing plate.

(6) In each of the physical embodiments of armor in accordance with the teachings of the present invention, once the armor is assembled with the ceramic material encapsulated within the metallic material, and the stiffening plate interposed between the ceramic material and the backing plate, the entire armor is heated to a temperature sufficiently high enough to cause the metal to be plastically deformed around the ceramic on the top and sides. In order for the metal to plastically deform about the ceramic in a controlled manner, the ceramic material must have dimensions so that it is as close as possible to the dimensions of the chamber in which the ceramic material is placed. The ceramic material must be strongly confined on all sides during thermal cycling so that, during the heating and cooling process, the ceramic is placed into compression. The degree of compression to which the ceramic material is exposed is a function of the thermal expansion mismatch between the metal and the ceramic, the change in temperature during the processing, the yield properties of the metal, the applied pressure, and the dimensions of the device itself.

(7) The encapsulation of the ceramic by metal has been found to allow for the phenomenon of interface defeat which increases the ballistic performance of the ceramic armor. Interface defeat is a phenomenon in which the projectile flows radially outwards on the surface of ceramics without penetrating it significantly. In making encapsulated parts for advanced armor systems, the relative dimensions of the ceramic and metal plates and frames are of much importance in determining the amount of compression on the ceramic, the areal density of the part and the stiffness of the armor. All of these variables are important for the phenomena of the dwell along with the type of metal and ceramic. Typical ceramic armor materials have densities nearly equal to or less than that of Titanium and include Silicon Carbide, Aluminum Nitride, Aluminum Oxide, and Titanium Diboride. The phenomenon of dwell has been recognized to be of much importance in achieving success for lightweight armor systems.

(8) The concept of the use of stiffening plates can be used for all methods of encapsulation. However, an advantage of the use of hot pressing a plate assembly is the simplicity of adding other elements such as stiffening plates to the construction. For encapsulation by methods using heat treatment, the stiffening plate should not react with the ceramic being encapsulated unless the difference in thermal expansion mismatch is minimal ($<1\times10^{-6}$ in/in at 1000° C.). The stiffening plate should also not react with the metal used for encapsulation unless the thermal expansion mismatch is less than $2\times10^{-6}$ in/in at 1000° C. One such element that Applicants have developed for stiffening Ti—SiC assemblies is a composite of Titanium and Titanium Boride. This material has a density similar to that of Titanium but stiffness that is greater than that of Titanium.

As such, it is a first object of the present invention to provide ceramic armor and a method of making it by encapsulation including use of a stiffening plate.

It is a further object of the present invention to provide such an armor in various embodiments thereof including those in which a single piece of ceramic is encapsulated within a single cavity adjacent a stiffening plate.

It is a still further object of the present invention to provide such a device in which a plurality of discrete ceramic pieces are each encapsulated adjacent stiffening plates within a sub-chamber within a metal portion.

It is a still further object of the present invention to provide such a device in which the chambers that receive the ceramic material and stiffening plate are formed through assembly of separate parts in situ.

It is a yet further object of the present invention to provide such a device in which the sub-chambers receiving the ceramic pieces and stiffening plate are formed through an EDM or conventionally milled process that mechanically forms the sub-chambers or cavities.

It is a still further object of the present invention to provide a method of creating ceramic armor in which the ceramic material and stiffening plate encapsulated with the metal material are subjected to a hot pressing process to cause the metal to be plastically deformed around the ceramic.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
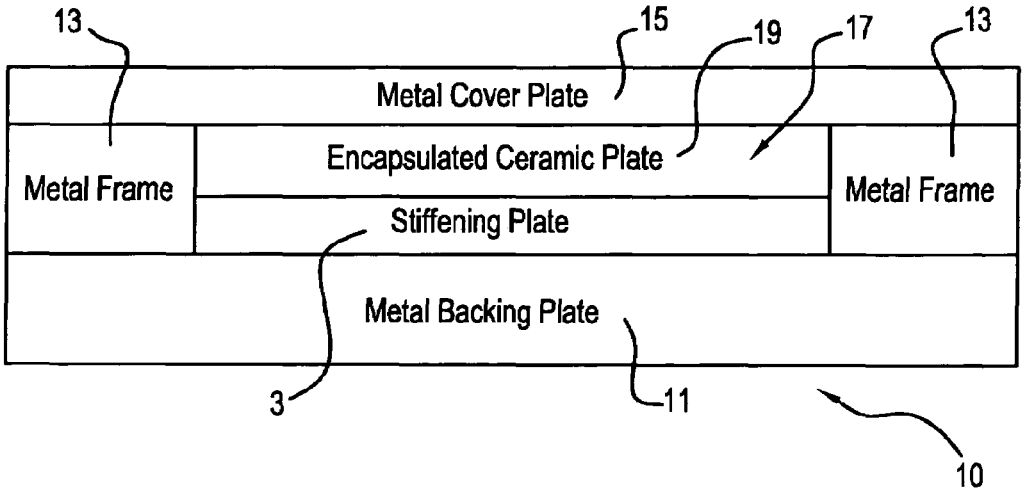
FIG. 1 shows a schematic cross-sectional representation of an armor construction encapsulating a ceramic plate and stiffening plate in accordance with the teachings of the present invention.
Figure 2:
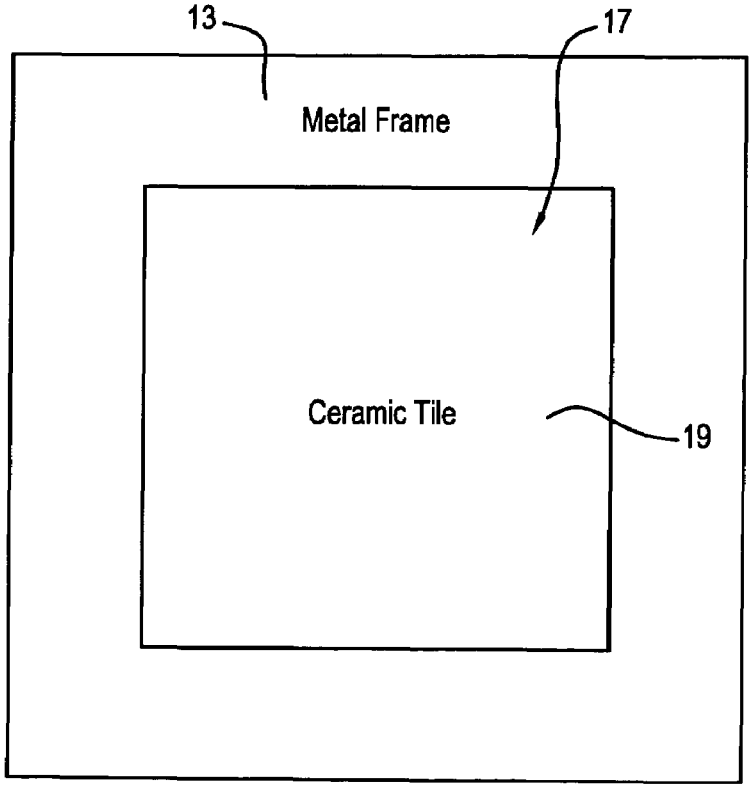
FIG. 2 shows a top view of the construction of FIG. 1.

Reference is first made to FIGS. 1 and 2 which show a schematic representation of a three layer construction in accordance with the teachings of the present invention. The inventive construction is generally designated by the reference numeral 10 and is seen to include a backing plate 11, a metal frame 13, and a cover plate 15, which combine to define an internal chamber 17. Within the chamber 17, a stiffening plate 3 and a ceramic plate or tile 19 are encapsulated. The stiffening plate 3 is interposed between the backing plate 11 and the ceramic plate or tile 19.

As shown in FIG. 2, the frame 13 may be generally rectangular, having the internal chamber 17 sized to closely receive the ceramic plate or tile 19 and the stiffening plate 3 therein.

Figure 3:
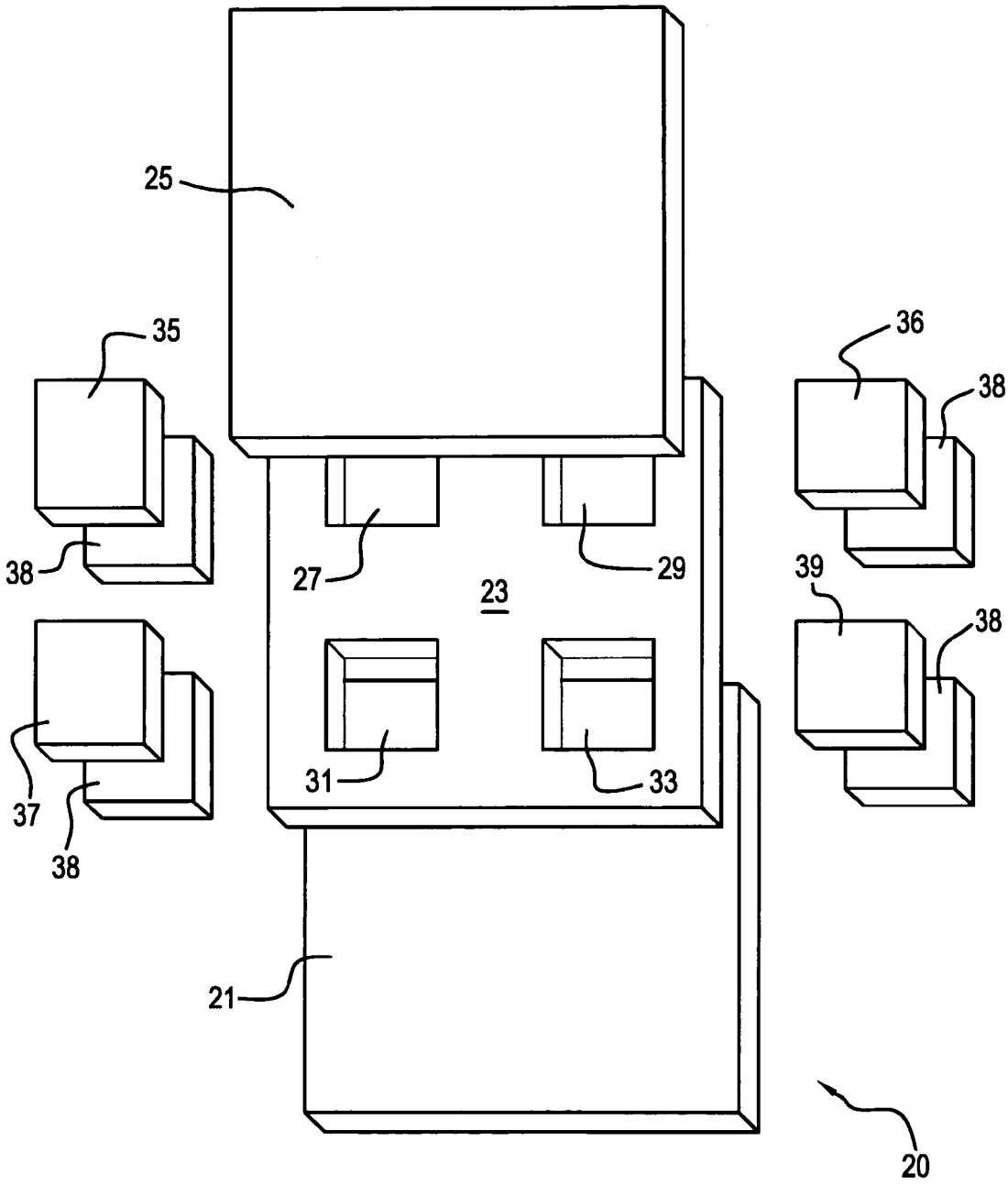
FIG. 3 shows an exploded perspective view of a second embodiment of the present invention.

With reference to FIG. 3, a second embodiment of the present invention is generally designated by the reference numeral 20 and is seen to include a backing plate 21, a middle plate 23, and a cover plate 25. The middle plate 23 has a plurality of cavities 27, 29, 31 and 33 formed therein through any desired manner including electrical discharge machining EDM processing or mechanical processing.

Ceramic tiles 35, 36, 37 and 39 and stiffening plates 38 are respectively received within the cavities 27, 29, 31 and 33, whereupon the cover plate 25 is placed thereover to encapsulate the ceramic tiles.

Figure 4:
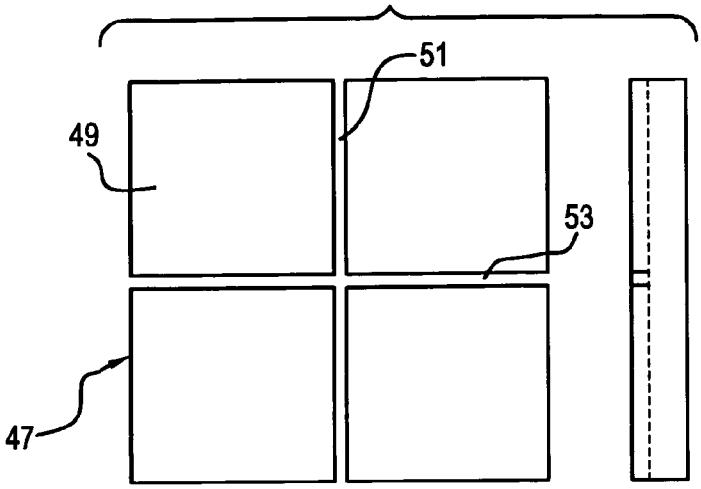
FIG. 4 shows a top view of a backing plate of a third embodiment of the present invention.
Figure 5:
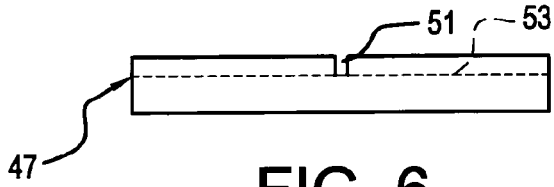
FIG. 5 shows a side view of the backing plate of FIG. 4.
Figure 8:
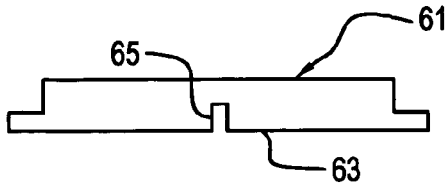
FIG. 8 shows a side view of a further cross beam to be assembled to the backing plate of FIGS. 4–5.
Figure 9:
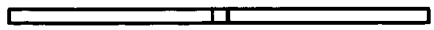
FIG. 9 shows a top view of the cross beam of FIG. 8.
Figure 10:
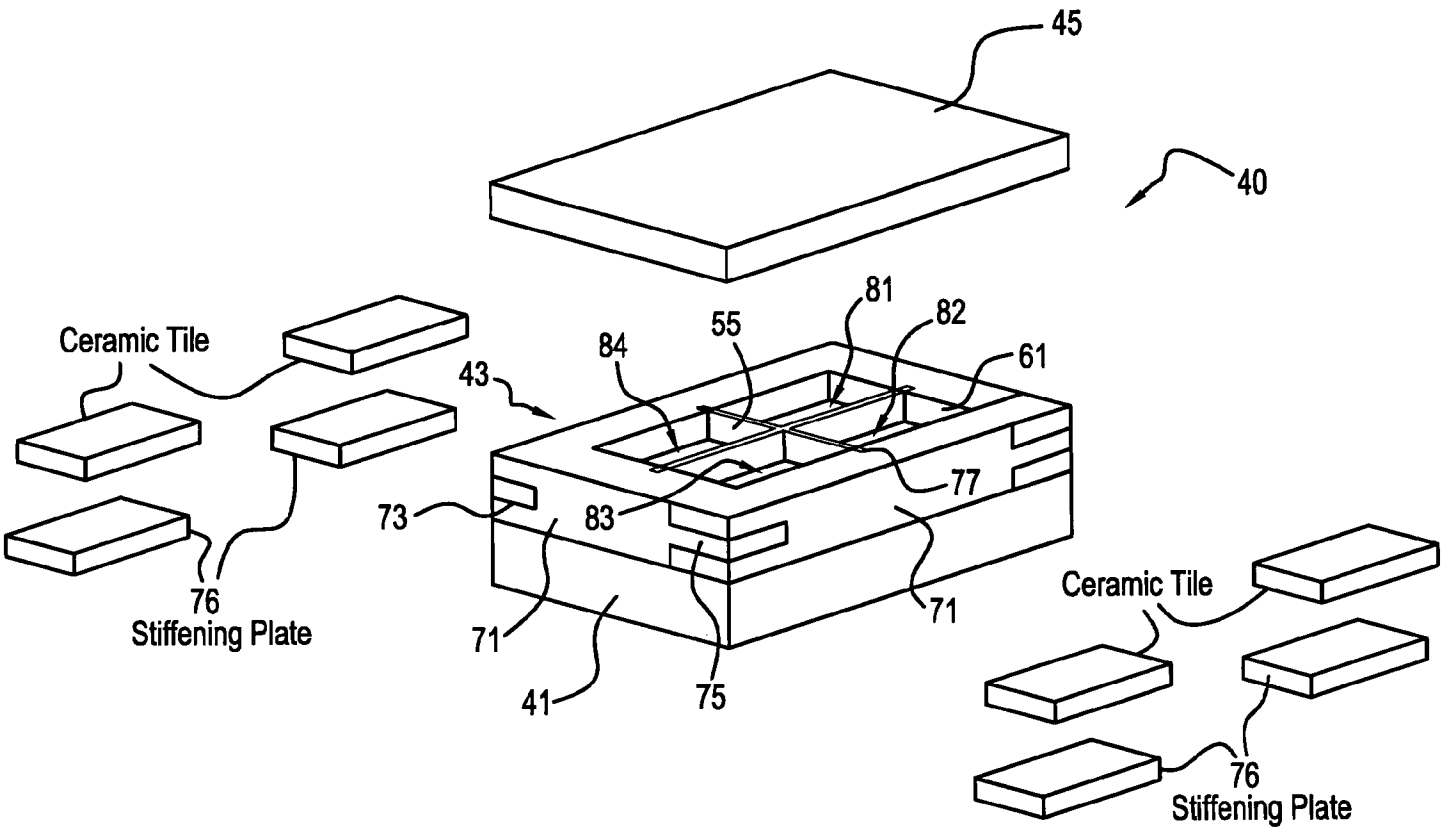
FIG. 10 shows a perspective view of the parts illustrated in FIGS. 4–9 as assembled together.

With reference, now, to FIGS. 4–10, a further embodiment of the present invention is generally designated by the reference numeral 40 (see FIG. 10). The embodiment 40 includes a backing plate 41, a frame structure 43, and a cover plate 45. With reference to FIGS. 4–9, the manner of assembly of the frame structure 43 will be explained. With reference, first, to FIGS. 4 and 5, the frame structure 43 includes a backing plate 47 having a top surface 49 into which crossing grooves 51 and 53 are formed, of which the groove 51 is also seen in full lines in FIG. 5, and the groove 53 is shown in phantom therein.

Figure 6:
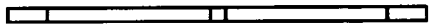
FIG. 6 shows a side view of a first cross beam to be assembled to the backing plate of FIGS. 4–5.
Figure 7:
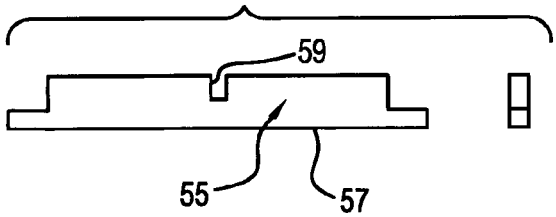
FIG. 7 shows a side view of the cross beam of FIG. 6.

With reference to FIGS. 6 and 7, a cross beam 55 has a bottom surface 57 inserted into the groove 51 and also includes an upper slot 59. With reference to FIGS. 8–9, a further cross beam 61 includes a bottom surface 63 designed to rest within the groove 53 and a slot 65 that is placed over the slot 59 in the beam 55 when assembled.

With reference to FIG. 10, the frame structure 43 is made up of four legs 71, each of which has a rear slot 73 and a forward protrusion 75 to form "tongue and groove" connections with adjacent legs 71. Each of the legs has a vertical slot 77 therein which is designed to receive one of the ends of either one of the cross beams 55 or 61. As assembled, the frame structure 43 defines four cavities 81, 82, 83 and 84. As before, each of these cavities closely receives a ceramic plate or tile and a stiffening plate 76, whereupon the cover plate 45 is placed thereover.

Figure 11:
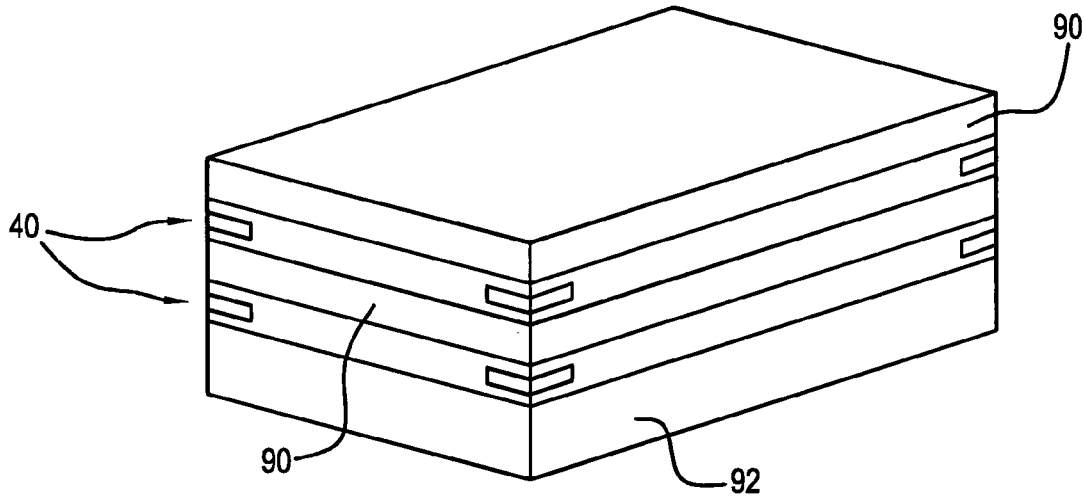
FIG. 11 shows a perspective view of a plurality of constructions of the embodiment of FIGS. 4–10 assembled together in vertically spaced layers.

FIG. 11 shows a ceramic armor made up of a plurality of armor constructions 40 stacked vertically with cover plates 90 and a backing plate 92 shown.

In each of the embodiments of the present invention, it is preferred that the stiffening plate(s) and ceramic plate or tile or plates or tiles is/are machined to be, in combination, within 0.005 inches of the corresponding dimensions of the sub-chambers or cells within which they are placed. In accordance with the teachings of the present invention, it is preferred that the metal material used to encapsulate the ceramic material consists of a material having relatively low density, high strength and good ductility along with a coefficient of thermal expansion higher than the coefficient of expansion for the ceramic material encapsulated therewithin. Applicants have found that an alloy of Titanium known as Ti-6Al-4V or Ti-6Al-4V ELI (Extra Low Interstitials) is a suitable material for this purpose. Ti-6Al-4V has a relatively low density (4.5 g/cc), relatively high strength (900 MPa), and good ductility (yield strength of 830 MPa at 0.2% yield), and can be bought already annealed according to Mil T 9046 spec. The thermal expansion of Ti-6Al-4V is about $10.5\times10^{-6}$ in/in ° C. from 0–600° C., a coefficient considerably higher than that of dense SiC which has a thermal expansion coefficient of $4.1\times10^{-6}$ in/in ° C. from 0–600° C., a difference in which the thermal expansion coefficient for the Titanium alloy is over 2½ times the thermal expansion coefficient for the ceramic material.

In the preferred embodiment of the present invention, the ceramic material employed may consist of pressure assisted (PAD) SiC—N, one of a family of Cercom's dense hot pressed ceramics. Other grades and types of armor ceramics such as Silicon Carbide, Boron Carbide, Tungsten Carbide, Titanium Diboride, Aluminum Oxide, Silicon Nitride and Aluminum Nitride or mixtures of the aforementioned materials can be employed. Such armor ceramics have thermal coefficients of expansion from about $3.0\times10^{-6}$ to about $9\times10^{-6}$ in/in ° C. and hardness greater than 1100 kg/mm$^2$.

The concept of stiffening plates can be used for all methods of encapsulation. However, an advantage of the use of hot pressing a plate assembly is the simplicity of adding other elements such as stiffening plates to the construction.

For encapsulation by methods using heat treatment, the stiffening plate should not react with the ceramic being encapsulated unless the difference in thermal expansion mismatch is minimal ($<1\times10^{-6}$ in/in ° C. at 1000° C.). The stiffening plate should also not react with the metal used for encapsulation unless the thermal expansion mismatch is less than $2\times10^{-6}$ in/in ° C. at 1000° C. However, such reaction does not reduce the effectiveness of the stiffening plate, but merely adds a bond at the interface.

Figure 14:
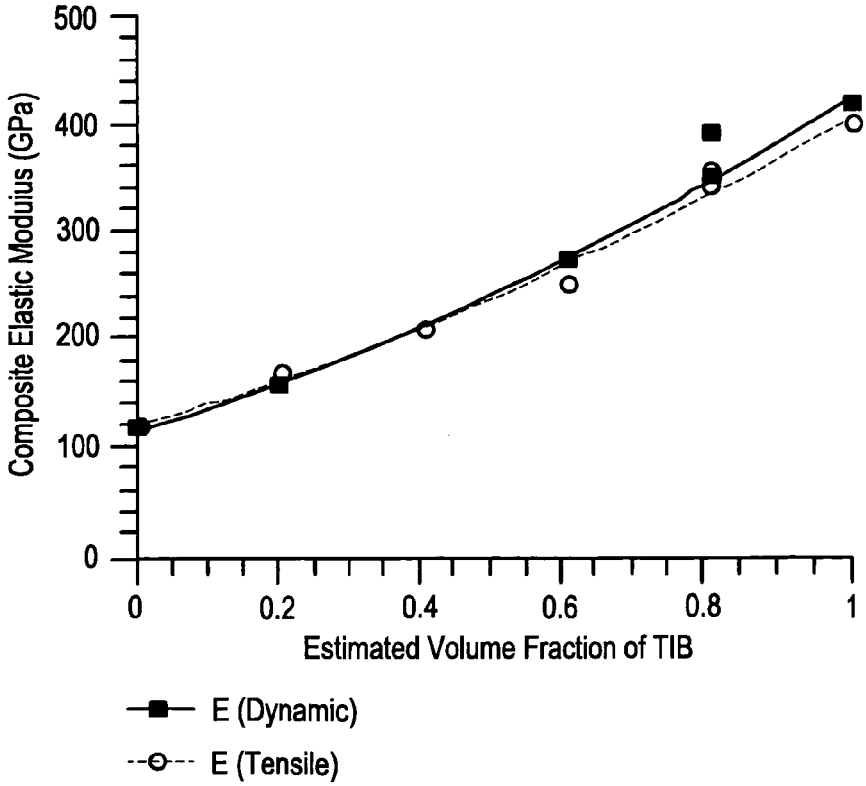
FIG. 14 shows a graph of the elastic modulus for varying volume fractions of TiB in a Ti—TiB composite.

One element that Applicants have developed for stiffening Ti—SiC assemblies is a composite of Titanium and Titanium Boride. This material has densities similar to Titanium but stiffness that is greater than Titanium. Table I shows the hot pressed density as a function of TiB content, and FIG. 14 shows the elastic modulus for different amounts of TiB.

TABLE I

Hot-Press Densities

| VOLUME FRACTION | DENSITY BY RULE OF MIXTURES (g/cc) |
|---|---|
| 0.0 | 4.500 |
| 0.2 | 4.538 |
| 0.4 | 4.576 |
| 0.6 | 4.614 |
| 0.8 | 4.652 |
| 1.0 | 4.690 |

Table II shows the tensile strength as a function of TiB content and Table III shows the Coefficient of Thermal Expansion (CTE).

TABLE II

Ultimate Tensile Strength of Ti, TiB, and Ti/TiB Composites

| Ultimate Tensile Strengths at Room Temperatures | |
|---|---|
| Composition | Tensile Strength |
| Ti | 720 MPa |
| 80 Ti/20 TiB | 550 MPa |
| 60 Ti/40 TiB | 260 MPa |
| 40 Ti/60 TiB | 270 MPa |
| 20 Ti/80 TiB | 360 MPa |
| TiB | 280 MPa |

TABLE III

Calculated Coefficient of Thermal Expansion (CTE) from 20° C. to 600° C. of Ti, TiB and Ti—TiB Composites

| Composition | CTE |
|---|---|
| Ti | $10.5\times10^{-6}$ in/in ° C. |
| 80 Ti/20 TiB | $9.5\times10^{-6}$ in/in ° C. |
| 60 Ti/40 TiB | $9.8\times10^{-6}$ in/in ° C. |
| 40 Ti/60 TiB | $10.2\times10^{-6}$ in/in ° C. |
| 20 Ti/80 TiB | $9.8\times10^{-6}$ in/in ° C. |
| TiB | $9.0\times10^{-6}$ in/in ° C. |

Figure 15:
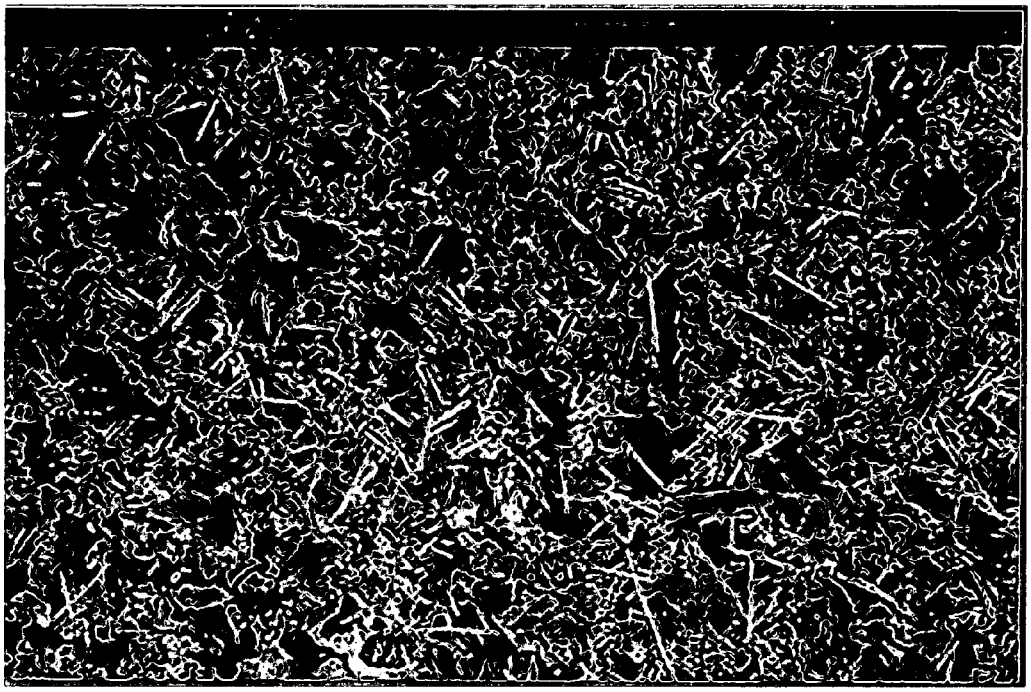
FIG. 15 comprises a photomicrograph showing the microstructure of an etched Ti—TiB composite used to create a stiffening plate.

From Table III, it is seen that all graphed compositions have a CTE similar to that of Titanium (within $2\times10^{-6}$ in/in ° C.). A match in CTE is important to prevent cracking when materials are pressed together and form a chemical bond. From FIGS. 14–15 and Tables I, II and III, it can be seen that the properties of the Ti—TiB composite can be tailored by changing the ratio of Titanium and Titanium Boride. For instance, the stiffness can be increased with increasing TiB content. The microstructure of the material with intermediate amounts of TiB contains a significant amount of whisker shaped grains (see FIG. 15). When the Ti/TiB composite material is produced by hot pressing, the grains can be oriented in particular planes as desired.

To illustrate this principle, Applicants have manufactured encapsulates containing SiC tiles and Ti/TiB stiffening plates and compared it to encapsulates with only SiC tiles. Encapsulates with the Ti/TiB stiffening plate performed better than the encapsulates with only Ti. An advantage of using the Titanium—Titanium Boride composite for stiffening purposes is that it may bond with the Titanium backing plate during hot pressing and provide a single mechanical unit below the ceramic. Mechanical interfaces in armor assemblies reflect shock waves and will stress the encapsulated body. Minimizing these interfaces is therefore important and is an advantage of using Ti—TiB composites for the stiffening plate. The Ti—TiB composite also has a similar coefficient of thermal expansion as that of Titanium and will therefore maintain similar compressive stresses in the ceramic as would a single Titanium backing plate.

Another advantage of adding a stiffening plate of Ti/TiB composite material to a Ti encapsulated SiC is that the stiffness of the backing plate can be increased while not changing the areal density of the encapsulated assembly. The stiffness in the backing plate of an encapsulated assembly is important to prevent the premature bending/cracking of the ceramic. The stiffening of the ceramic decreases the backside deformation and prolongs the time of dwell. The use of Ti/TiB plate also does not significantly change the amount of compression on the ceramic. The thermal expansions of Ti/TiB and Ti are fairly similar.

Besides using cermets (ceramic metal composites) such as Ti/TiB for the stiffening plates, other ceramic materials could be used. Examples of these materials are WC, $B_4C$, $Al_2O_3$ and $TiB_2$. Compared to Silicon Carbide, which has a Young's Modulus of 450 GPa, WC has a Young's Modulus of 695 GPa, $TiB_2$ has a Young's Modulus of 555 GPa, $B_4C$ has a Young's Modulus of 450 GPa and $Al_2O_3$ has a Young's Modulus of 385 GPa. Thin plates of these materials act to significantly stiffen the assembly. Plates of $B_4C$ add stiffness at reduced weight. $B_4C$ has a theoretical density of 2.52 g/cc while SiC has a density of 3.22 g/cc.

The encapsulation of WC, $B_4C$ and $TiB_2$ stiffening plates is very similar to that of the bulk SiC ceramic. The SiC material shows no significant reaction between it and the Titanium at temperatures of up to 1000° C. and has a lower thermal expansion than Titanium. WC, $B_4C$ and $TiB_2$ also show no significant reaction with the Titanium at 900–1000° C. and they have a thermal expansion less than Titanium. For encapsulation at higher temperatures, CVD or PVD coating could be used to prevent reaction between the ceramic and the Titanium. In tests with SiC, PVD and CVD, coatings of TiN and TiC were used to prevent reaction between the SiC and the Ti at higher temperatures. In addition to WC, $B_4C$ and $TiB_2$' other armor ceramics could be used for this application.

In practicing the method of hot pressing the ceramic armor in accordance with any of the embodiments of the present invention, after the ceramic material is completely encapsulated within the metal material with the stiffening plate in place, the hot pressing operation commences by placing the assembly within a furnace contained within a chamber in which pressure can be controlled by a mechanical or hydraulic press. The temperature is then increased sufficiently such that the metal encapsulating the ceramic is plastically deformed around the ceramic while contained within a die of refractory material. The degree of compression of the ceramic that is produced during hot pressing is a function of the thermal expansion mismatch between the metal and ceramic, the rate of temperature decrease during processing, the yield properties of the metal, and the dimensions of the components. The stiffening plate typically does not react with the ceramic material but may form a bond at its interface with the backing plate.

Concerning each of the embodiments of the ceramic armor described in detail hereinabove, the method of encapsulating the ceramic material within the Titanium alloy is the same. The process steps are as follows:

(1) First, all surfaces of the Titanium alloy must be degreased and cleaned. Degreasing can be done by steam cleaning, alkaline cleaning, vapor degreasing or solvent cleaning. Where the surfaces are diamond machined and have a light oxide film, mechanical cleaning by an abrasive pad such as that which is known by the Trademark "SCOTCH BRITE," abrasive sand blasting, wire brushing or draw filing is sufficient. Where the surfaces have been machined, as is the case in the embodiment of FIG. 3, and have a heavier oxide film, the alloy surfaces that have been so machined should be cleaned by a combination of degreasing, molten salt descaling, acid pickling, and abrasive grinding or polishing. In the preferred process, acid cleaning should be carried out with a mixture of 1–2% HF and 15–40% nitric acid for 1 to 5 minutes at room temperature. The ratio of nitric acid to hydrofluoric acid (HF) should be at least 15.

(2) The ceramic tiles or plates should be degreased using suitable degreasing agents such as, for example, isopropanol followed by acetone. If metal marks exist, an acid cleaning should be performed.

(3) A refractory die such as one made of graphite is prepared with the walls of the die and spacers thereof first coated with mold release agents such as graphite foil. The graphite foil besides acting as a mold release agent is provided to ensure a tight fitting die. Examples of suitable thickness for the graphite foil are 0.010 to 0.040" depending upon the actual die and the piece being hot pressed. The walls and surfaces of the spacers are then coated with a Titanium foil having a suitable thickness. One example of a suitable thickness for the Titanium foil is 0.008", although other thicknesses can be equally effective.

(4) The material is then loaded into the die with the bottom of the die cavity having at least 1–2 graphite spacers. Depending upon the complexity of the part, the order in which the part is loaded into the die can vary. Where the ceramic armor consists of a single piece of ceramic and a single stiffening plate encapsulated by a Titanium alloy, the backing plate is loaded first followed by the stiffening plate, the ceramic and then the other structures of the Titanium alloy frame. For complex ceramic armor such as those illustrated in FIGS. 3–11, the entire ceramic armor structure is loaded into the die together with the Titanium alloy cover plate put on top of the frame containing the ceramic plates or tiles. A graphite spacer is then placed on top of the entire assembly. Where multiple assemblies will be placed into the die simultaneously, graphite spacers are placed between each separate assembly.

(5) The die with the assembly or assemblies therein is then loaded into a vacuum hot press. The vacuum hot press consists of a furnace in which the die may be received, with the furnace contained within a sealed chamber in which the internal pressure may be adjusted and inert gas such as Argon may be supplied and exhausted. The atmosphere within the hot press is then preferably lowered to an atmosphere of less than 1.5 torr. Of course, as known to those skilled in the art, higher atmospheric pressures may also be effectively employed if sufficient oxygen gettering material is used in the furnace.

Figure 13:
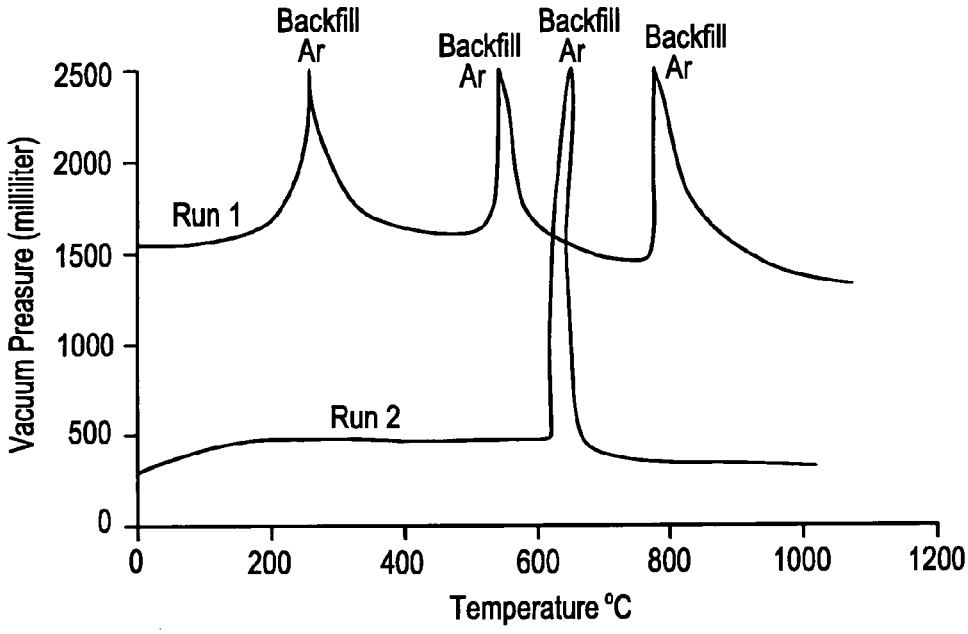
FIG. 13 shows a graph of a portion of the hot pressing process during the portion thereof when temperature is being increased and showing several backfilling and evacuating steps.

(6) Once the required vacuum atmosphere has been achieved, the chamber is heated up to a temperature of about 800° C. and, depending on vacuum level, several optional purging and evacuation cycles may be undertaken (FIG. 13) in which the chamber is first purged with Argon and then evacuated. These cycles are not essential to the process. Once the temperature reaches 800° C., the purging and evacuation steps, if they were employed, are no longer undertaken and the atmosphere is maintained at a level of less than 1.5 torr. Alternatively, the process at and above 800° C. may be undertaken in an inert atmosphere such as high purity Argon.

(7) As the temperature continues to increase, once it reaches a temperature in which the metal can easily diffuse, the physical pressure applied to the armor assembly is increased and bonding is begun. For metals, the temperature at which diffusion usually occurs at rates sufficient for diffusion bonding is equal to, or greater than, one-half the melting temperature of the material. For Titanium and its alloys, the melting temperature is between 1575 and 1725° C. For Ti-6Al-4V, the melting temperature is 1650° C. and, therefore, the minimum temperature for hot pressing this alloy is 825° C. After achieving this temperature, the temperature is increased to its final temperature of 900 to 1300° C., and the necessary physical pressure is applied. Of course, the necessary physical pressure is a function of temperature and may fall within the range of 250 psi to 5000 psi. With increased pressures and temperature, significant plastic deformation of the Titanium alloy occurs accompanied by increased diffusion rates. The bond formed between the Titanium pieces is a diffusion bond and artifacts of the bond are seen to cross individual grains at temperatures between 900 and 1000° C. and hold times of 2.5 hours. For temperatures greater than 1000° C., artifacts of the bond are not visible by microscopic analysis. Applicants have found that one may conclude that diffusion and grain growth have occurred in the material and that the bond is a "diffusion" bond. The significant plastic deformation that occurs at this temperature and pressure aids in grain-to-grain contact. The 900° C. temperature and increased pressure are held for up to 2½ hours. For larger sized ceramic armor pieces, the hold times are increased along with reduction in heating rates. For lower temperature bonding, additives or coatings can be added to the Titanium surfaces to increase the local diffusion rate across the interface.

Figure 12:
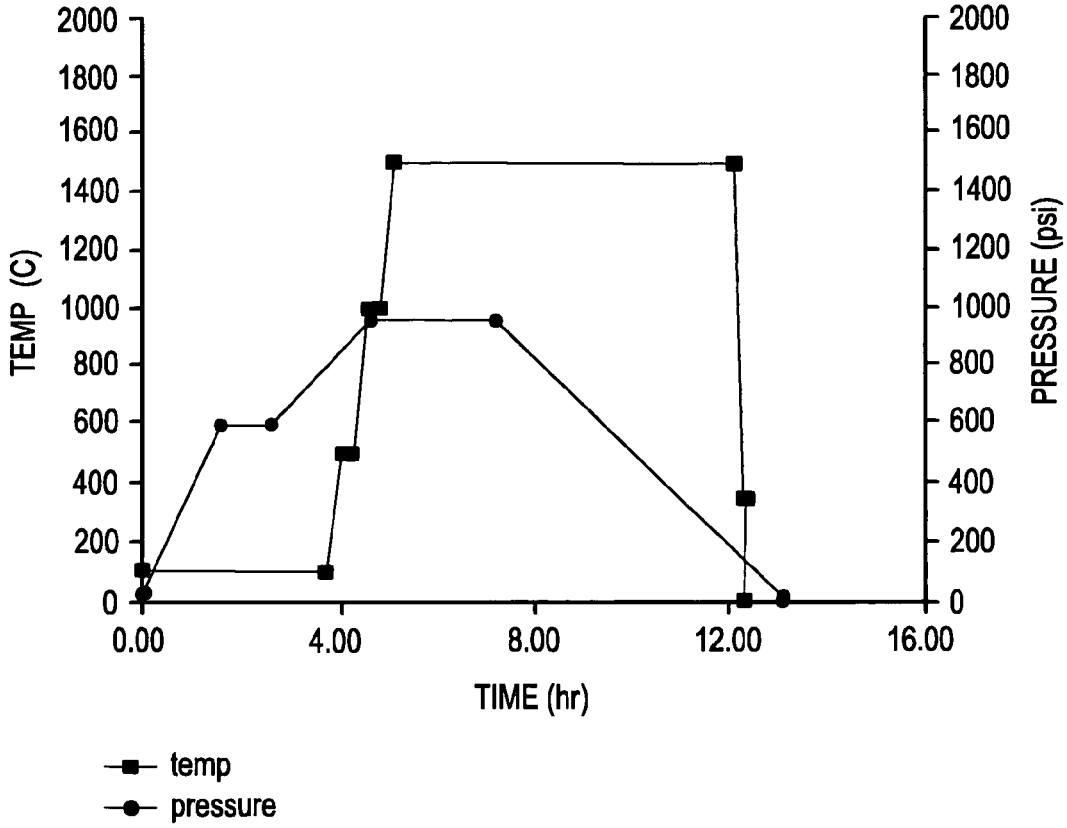
FIG. 12 shows a graph of temperature and pressure versus time for the conducting of the hot pressing process for encapsulating the metal alloy and ceramic material together.

FIG. 12 shows a graph of temperature and pressure versus time for the process as practiced in accordance with the teachings of the present invention.

As such, an invention has been disclosed in terms of preferred embodiments thereof that fulfill each and every one of the objects of the invention as set forth hereinabove, and provide a new and useful ceramic armor and method of making by encapsulation including use of a stiffening plate of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A ceramic armor, comprising:

(a) a ceramic material body having one side engaging a cermet composite or armor ceramic stiffening plate, a metallic material surrounding said ceramic material body and stiffening plate, with said stiffening plate being interposed between said one side of said ceramic material and said metallic material; and (b) said ceramic material body having other sides, said metallic material being plastically deformed about said other sides of said ceramic material body; and (c) said stiffening plate being stiffer than said metallic material.

2. The ceramic armor of claim 1, wherein said metallic material has a coefficient of thermal expansion (CTE) greater than a CTE of said ceramic material body, and said stiffening plate has an elastic modulus greater than that of the metallic material.

3. The ceramic armor of claim 1, wherein said metallic material comprises a Titanium alloy.

4. The ceramic armor of claim 1, wherein said metallic material comprises a Titanium alloy, and said stiffening plate comprises a Ti—TiB composite.

5. The ceramic armor of claim 1, wherein said metallic material comprises a Titanium alloy, and said stiffening plate comprises an armor ceramic.

6. The ceramic armor of claim 1, wherein said metallic material comprises a Titanium alloy, and said stiffening plate comprises an armor ceramic chosen from the group consisting of WC, $B_4C$, $Al_2O_3$ and $TiB_2$.

7. The ceramic armor of claim 6, wherein said Titanium alloy comprises Ti-6Al-4V or Ti-6Al-4V ELI.

8. The ceramic armor of claim 7, wherein said ceramic material body comprises a dense SiC ceramic material comprising pressure assisted SiC-N.

9. The ceramic armor of claim 8, wherein elastic modulus of the Titanium alloy is about 115 GPa, elastic modulus of the ceramic material body is about 450 GPa, and elastic modulus of the stiffening plate is greater than 130 GPa.

10. The ceramic armor of claim 1, wherein said metallic material comprises a three piece assembly consisting of a backing plate, a frame having an open center, and a cover plate, said assembly defining an internal chamber designed to closely receive said ceramic material body and stiffening plate being interposed between said ceramic material body and said backing plate.

11. The ceramic armor of claim 10, wherein said frame includes a plurality of cavities therein, each of said cavities being closely filled with a ceramic material body and a stiffening plate.

12. The ceramic armor of claim 11, wherein said plurality of cavities comprises four cavities, each filled with a ceramic tile or plate and a stiffening plate.

13. The ceramic armor of claim 12, wherein said frame includes a plurality of separate side pieces assembled together to form a periphery, and a pair of cross members connected between opposed side pieces to define said cavities.

14. The ceramic armor of claim 12, wherein said three piece assembly comprises a first three piece assembly, said ceramic armor further including at least one additional three piece assembly, said three piece assemblies being stacked vertically.

* * * * *